United States Patent [19]

Gill

[11] 4,022,286

[45] May 10, 1977

[54] AUGER

[75] Inventor: Joseph Anthony Gill, Darfield, England

[73] Assignee: Leeco, Inc.

[22] Filed: Sept. 5, 1975

[21] Appl. No.: 610,560

[52] U.S. Cl. ..... 175/313; 175/394; 175/422; 239/118; 299/17; 299/81; 175/393

[51] Int. Cl.[2] ..... E21C 13/04

[58] Field of Search ..... 175/394, 393, 62, 422, 175/315, 313; 299/81, 17, 12; 239/116, 117, 118

[56] References Cited

UNITED STATES PATENTS

| | | | |
|---|---|---|---|
| 1,343,902 | 6/1920 | Chapman | 175/394 X |
| 1,659,327 | 2/1928 | Montgomery | 175/393 X |
| 2,304,456 | 12/1942 | Hall | 239/118 X |
| 2,495,840 | 1/1950 | Findater | 299/81 X |
| 2,675,213 | 4/1954 | Poole et al. | 175/393 X |
| 2,699,968 | 1/1955 | Meyer | 239/118 |
| 2,780,439 | 2/1957 | Kandle | 175/394 X |
| 3,847,439 | 11/1974 | Allen et al. | 299/81 |
| 3,904,246 | 9/1975 | Gandy et al. | 299/12 |

*Primary Examiner*—Ernest R. Purser
*Assistant Examiner*—Richard E. Favreau
*Attorney, Agent, or Firm*—Pravel, Wilson & Gambrell

[57] ABSTRACT

An auger for use in a continuous mining operation having an elongate tubular member in communication with a fluid pressure source and a scroll mounted on the tubular member with spray mechanisms for spraying fluid into the air adjacent the peripheral edge of the scroll for preventing suspension of mined undesired contaminate particulate matter within the air adjacent to the continuous mining operation.

16 Claims, 4 Drawing Figures

AUGER

BACKGROUND OF THE INVENTION

The field of this invention is augers, particularly of the type used in continuous mining operations.

One of the most significant health and safety problems involved with continuous mining operations revolves about the suspension of contaminates within the air adjacent to and in the vicinity of such a mining operation. For example, during coal mining operations, the suspension of coal dust presents a very real threat to the health and safety of miners in the adjoining areas inasmuch as the coal dust is extremely explosive in its suspended state as well as a traceable cause of "black lung," a notorious disease common to coal miners who breathe such coal dust on a daily basis.

Many attempts have been made at ways to remove the suspended contaminate from the air. As far as known, prior devices attempt to remove contaminate particles after becoming suspended in the air rather than effecting to prevent the deleterious suspension of such particles.

One attempt in the prior art has been to use water sprays mounted with the central tubular member of the auger for spraying water generally into the mine bore. However, this has not been effective in reducing contaminate particles to safe levels.

SUMMARY OF THE INVENTION

The present invention relates to a new and improved auger for use in a continuous mining operation for preventing the suspension of mined undesired contaminate particulate matter within the air adjacent to the continuous mining operation. The new and improved auger includes a tubular member in communication with a fluid pressure source and a scroll mounted on the tubular member with spray mechanisms terminating adjacent the outer peripheral edge of the scroll and in communication with the fluid pressure source for preventing suspension of mined undesired contaminate particulate matter within the air adjacent to the continuous mining operation.

DESCRIPTION OF THE PREFERRED EMBODIMENT

Figure 1:
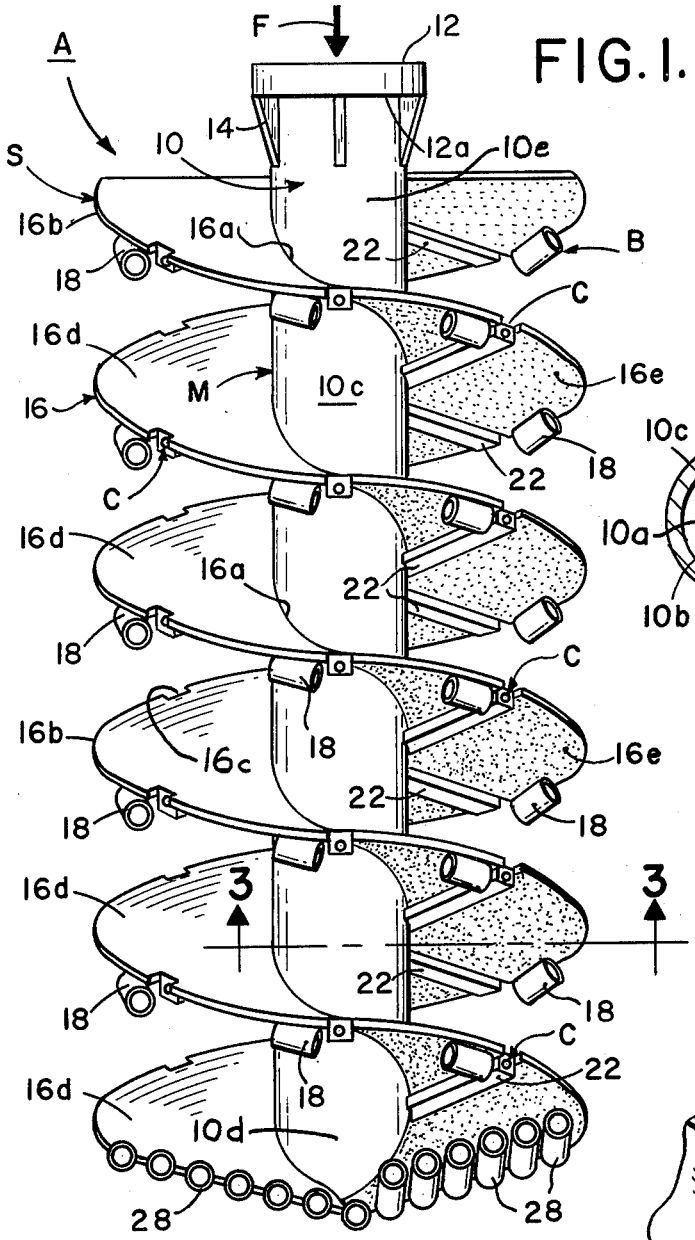
FIG. 1 is an elevational view showing the auger of the present invention.

In the drawings, the letter A designates the auger of the present invention. The auger A includes an elongate tubular member M having a scroll S therewith and spray means C mounted thereon and in communication with fluid pressure means F. Unless otherwise noted, the components of this invention are made of steel capable of taking heavy stresses and strains without failure, although other suitable high-strength materials may be used if desired.

The elongate tubular member M includes member 10 having a longitudinal bore 10*a* (FIG. 3) formed therein and having the annular surface 10*b* defining the outer portion of bore 10*a*. Member 10 also includes an outer annular surface 10*c*. Further, the member 10 includes a first end 10*d* (FIG. 1) and a second end 10*e*. Mounting plate 12 is mounted with the second end 10*e* of member 10 and has supporting ribs 14 attached to face 12*a* of mounting plate 12 and the outer annular surface 10*c* adjacent second end 10*e* of member 10. The mounting plate is adapted to be affixed to a continuous miner machine for positioning in a mine tunnel for supporting the auger for rotative insertion into the end of the tunnel walls (not shown). Typically, the mounting plate 12 may be bolted or in other suitable fashion removably affixed to such a continuous miner. Supporting ribs 14 act to support the auger A of the present invention as affixed to the continuous miner by the mounting plate 12 in such cantilever-type configuration. A plurality of openings 10*f* (FIG. 3) are formed about the tubular member M as discussed further hereinbelow.

The auger A of the present invention further includes a scroll S mounted on the elongate tubular member M. The scroll S includes a blade surface 16 having an inner peripheral edge 16*a* mounted with the outer annular surface 10*c* of the member 10 for mounting the scroll S with the tubular member M. The blade surface 16 further includes an outer peripheral edge 16*b* having a plurality of indents 16*c* formed about the outer peripheral edge 16*b*. Preferably, the blade surface 16 radially spirals along the longitudinal axis of the tubular member M from the first end 10*d* to the second end 10*e*. Preferably, the blade surface 16 is of a flat cross-sectional area having a face 16*d* and a back portion 16*e*.

Figure 3:
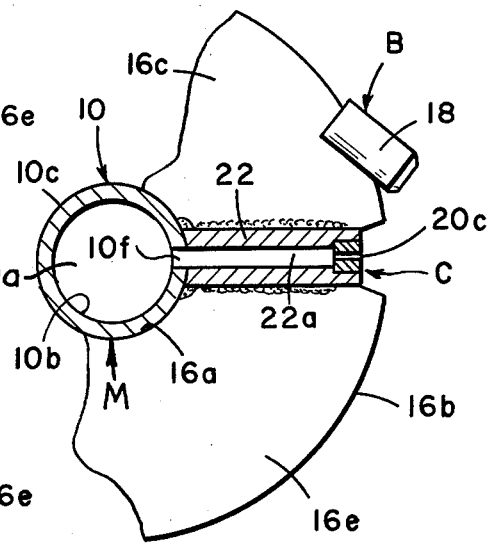
FIG. 3 is an end view, partly in section, of the auger of the present invention taken along the lines 3—3 of FIG. 1; and, FIG. 4 is a sectional view of the spray means of the present invention.
Figure 2:
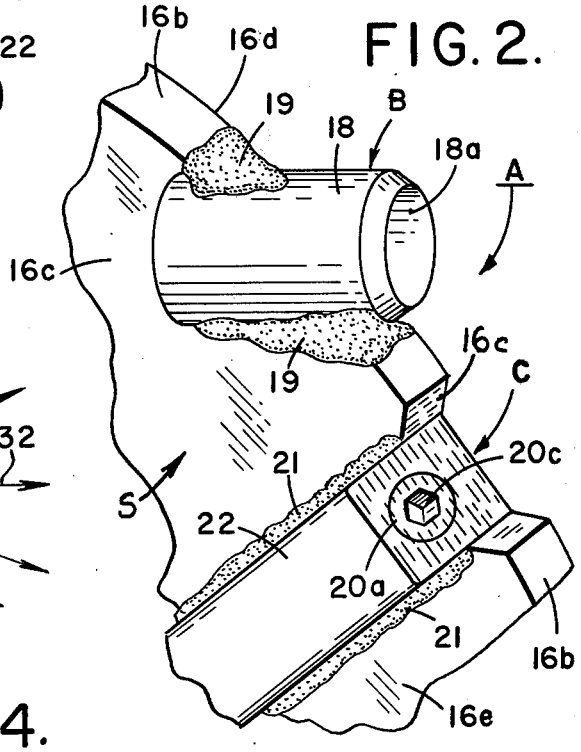
FIG. 2 is an enlarged, sectional detail of the outer peripheral edge of the scroll having the spray means and bit means therewith.

Bit means B are mounted adjacent the outer peripheral edge 16*b* of the scroll S for mounting appropriate cutting tools for cutting into and loosening mined materials for removal from the mine. Bit means B include bit holders 18. The bit holder 18 may be of any suitable configuration, however, as shown in FIGS. 1, 2 and 3, the bit holder 18 may be of a tubular configuration. As such, the bit holder 18 has an inner bore 18*a* adapted to receivably mount a suitable bit (not shown) for appropriate cutting and mining of the materials to be mined. The bit holder 18 is mounted adjacent the outer peripheral edge 16*b* of the scroll S on the back portion 16*e* of the blade surface 16 by weldments 19 or in any other suitable manner with the angle of the bit holder 18 with respect to the outer peripheral edge 16*b* varying in accordance with the type of materials to be mined and the type of bits used. Preferably, a plurality of such bit holders 18 are disposed about the outer peripheral edge 16*b*.

The auger A of the present invention further includes spray means C terminating adjacent the outer peripheral edge 16*b* of the scroll S. The spray means C includes a body member 20 mounted adjacent the outer peripheral edge 16*b* of the scroll S adjacent indents 16*c* formed in the blade surface 16. The body member 20 may be of any suitable configuration however preferably, the body member 20 is of a cylindrical configuration having an annular surface 20*a* and base portion 20*b* having an orifice 20*c* formed therein.

Figure 4:
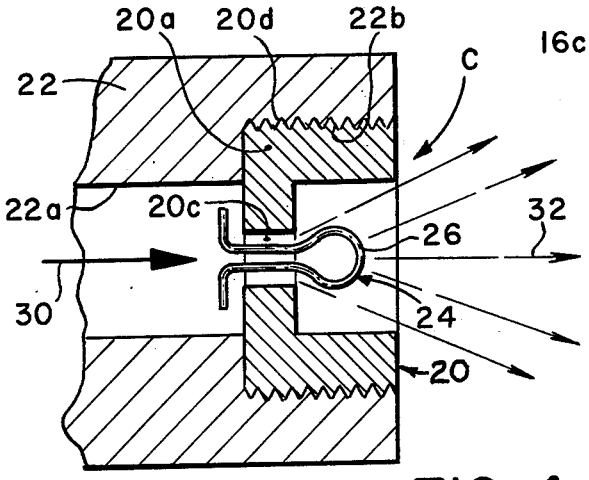

Any suitable means such as channel 22 may be incorporated to allow communication therebetween body member 20 and opening 10*f* formed in member 10. Channel 22 is preferably mounted with back portion 16*e* of the blade surface 16 by weldments 21 or in any other suitable manner such that a passageway 22*a* (FIG. 3) is formed therebetween opening 10*f* of member 10 and the orifice 20*c* of the body member 20 of the spray means C. Of course, the channel may be formed within the scroll S if desired. As shown in FIG. 4, the body member 20 has threads 20*d* which threadedly engage threads 22*b* of the channel 22 to threadedly mount the body member 20 therewith to enhance removability and/or replacement capability thereof.

The spray means C includes means mounted with the body member 20 for preventing clogging thereof. Such means includes insert means 24 movably mounted in the orifice 20*c* of the body member 20 which is capable of being agitated by fluid flowing through the orifice 20*c* to prevent clogging of the orifice 20*c* with mined particles during the continuous mining operations while enhancing the dispersion of fluid. The insert means 24 may include a cotter pin 26 disposed within the orifice 20*c*. It is intended that the cotter pin 26 fit loosely within the orifice 20*c* so that it may be easily agitated by co-action with the fluid for preventing clogging of orifice 20*c* during mining operations.

In the use or operation of the auger A of the present invention, the mounting plate 12 is appropriately affixed to a continuous miner (not shown). Such a continuous miner, as is well known, provides means for rotating the auger A adjacent the interconnect surfaces at mounting plate 12. Further, the continuous miner includes a fluid pressure means F, schematically indicated in FIG. 1, in communication with the longitudinal bore 10*a* of the member 10. The fluid pressure means F may include any suitable pumping source capable of providing high-pressure fluid for the auger A of the present invention. For example, if the auger A of the present invention were to be used for a coal mining operation, it would be desirable that the fluid pressure means F be capable of supplying a fluid, such as water, at a pressure of 300 pounds per square inch. As such, the tubular member M is adapted to be rotated by the continuous miner while being supplied with fluid under pressure from the fluid pressure means F.

The continuous miner directs the auger A into the area desired to be mined. End bit holders 28 mounted adjacent the first end 10*d* of the tubular member M and therewith the scroll S are adapted to mount bits (not shown) therewith for making the initial cuts into the material desired to be withdrawn by the mining operation.

Fluid from the fluid pressure means F enters the longitudinal bore 10*a* of member 10 and fills the entire cavity within the annular surface 10*b* of the member 10. Thereafter, the fluid under pressure is directed radially outwardly through openings 10*f* in the member 10, through radial passageways 22*a* in channels 22 in the direction of arrow 30 (FIG. 4), radially therethrough orifice 20*c* in body member 20 and radially outwardly therefrom in the direction of arrows 32. The fluid acts upon insert means 24 for agitating the same and such agitation prevents clogging of the orifice 20*c* during a mining operation. As the auger A is directed towards the materials to be mined, the scroll S is rotating while the spray means C discharges high-pressure fluid.

Once mining procedures are initiated, the scroll S rotates resulting in spiralling action thereof whereafter mined materials are carried along the length of the tubular member M by the face 16*d* of the blade surface 16 by rotation thereof. As the auger A bores deeper into the mined materials, the bits (not shown) fitted in aligned relation within bit holders 18 engage the material to be mined. The cutting tool digs into the mined material at a critical point at the leading edge of the cutting surface. It is at this point that incipient contaminate particles are generated. Due to spray being discharged and simultaneously directed at the cutting tool, the dust or other undesired contaminate particulate matter has little, if any, opportunity to become suspended in the air adjacent to such operation. The high-pressure fluid is directed at the cutting tool while the tool is actually working at this point of incipient contaminate particulate generation which prevents the suspension of undesired particles in the air in the vicinity thereof.

The body members 20 are mounted adjacent the indents 16*c* in proximity to the outer peripheral edge 16*b* of the blade surface 16 so as to protect the body member 20 from engaging the material to be mined and help prevent damage to the same during such mining operations. Thus, the spray means C terminates adjacent to the bit means B on the outer peripheral edge 16*c* of the scroll S to enhance the direction of the high-pressure fluid from the spray means C at the undesired contaminate particulate matter typically generated during mining operations for preventing suspension of such undesired contaminate particulate matter within the air.

For example, while not intending to be limited thereby, but for exemplary purposes only, during the mining of coal, conventional equipment for removing coal dust from the air results in air having seven miligrams of coal dust per cubic centimeter of air over an eight-hour period while the auger of the present invention results in effectively preventing the suspension of coal dust within the air such that readings on the order of two miligrams of coal dust per cubic centimeter of air were achieved, therefore, substantially increasing the purity and quality of the air adjacent to such a mining operation.

In addition to the insert means 24 preventing clogging of the orifice 20*c* of the body member 20 of the spray means C, the cotter pin 26 also acts to help disperse the high-pressure fluid exiting in the direction of arrows 32. Further, the entire system may be backwashed by directing high-pressure fluid in the opposite direction of arrows 32 through orifice 20*c*, passageway 22*a*, opening 10*f* and therethrough longitudinal bore 10*a* of member 10 for cleaning the same for proper maintenance thereof.

Mere changes in the configurations of insert means 24 will result in a wide variety of spray patterns for fluid dispersion necessary to satisfy the varying conditions dependent upon the materials to be mined. For example, cotter pin 26 results in multiple streams of high-pressure fluid being dispersed outwardly therefrom the body member 20 while alternative insert means 24 may be used to result in a finely atomized spray or any other desirable type of fluid dispersement necessary for preventing suspension of mined materials within the air adjacent to such a mining operation.

Thus, the auger A of the present invention provides an effective means for increasing mining safety as well as promoting a significantly healthier atmospheric environment during mining operations.

The foregoing disclosure and description of the invention are illustrative and explanatory thereof, and various changes in the size, shape and materials as well as in the details of the illustrated construction may be made without departing from the spirit of the invention.

I claim:

1. An auger for use in a continuous mining operation for preventing suspension of mined undesired contaminate particulate matter within the air adjacent to the continuous mining operation, comprising:

an elongate tubular member having a longitudinal bore formed therein and having a first end and a second end, said longitudinal bore of said tubular member adapted to be in communication with fluid pressure means adjacent said second end, said tubular member adapted to be rotated adjacent said second end;

a scroll having an inner peripheral edge and an outer peripheral edge for use in mining materials from the mine, said scroll radially spiralling along the longitudinal axis of said tubular member from said first end to said second end with said inner peripheral edge being mounted with said tubular member such that rotation of said tubular member results in rotation of said scroll for mining materials from the mine while generating undesired contaminate particulate matter;

spray means terminating adjacent said outer peripheral edge of said scroll and in fluid communication with said fluid pressure means for spraying fluid into the air adjacent said outer peripheral edge of said scroll preventing suspension of mined undesired contaminate particulate matter within the air adjacent to the continuous mining operation; and, anti-clogging means being affixed with said spray means for continuously preventing clogging of said spray means during spraying of the fluid.

2. The auger of claim 1, wherein:

said spray means directs fluid from said fluid pressure means in a radial direction substantially perpendicular to the longitudinal axis of said tubular member.

3. The auger of claim 1, further including:

bit means mounted adjacent said outer peripheral edge of said scroll for mounting appropriate cutting tools for cutting into and loosening the mined materials for removal from the mine.

4. The auger of claim 3, wherein:

said spray means terminating adjacent to said bit means on said outer peripheral edge of said scroll to enhance the direction of fluid from said spray means at said bit means for preventing suspension of undesired contaminate particulate matter within the air in proximity to said bit means.

5. The auger of claim 1, wherein said spray means further includes:

at least one body member adapted to be mounted with said scroll, said body member having an orifice formed therein, said body member being in fluid communication with said fluid pressure means.

6. The auger of claim 5, wherein said anticlogging means includes:

insert means movably mounted in said orifice of said body member for agitation by the fluid flowing through said orifice to prevent clogging of said orifice with mined particulate matter during continuous mining operations and to enhance dispersion of the fluid.

7. The auger of claim 6, wherein said insert means includes:

a cotter pin disposed within said orifice and adapted to be agitated by the fluid flowing through said orifice preventing clogging of said orifice and enhancing dispersion of the fluid.

8. The auger of claim 1, wherein:

said scroll has a face for conveying mined materials along the longitudinal axis of the tubular member by rotation of said tubular member and said scroll therewith and a back portion in opposed relation to said face, said spray means being mounted on said back portion of said scroll.

9. The auger of claim 9, further including:

channel means mounted on said back portion of said scroll for providing the fluid interconnection therebetween said longitudinal bore of said tubular member having said fluid pressure means therewith and said spray means.

10. The auger of claim 9, wherein:

said channel means is mounted on said scroll substantially radially perpendicular to the longitudinal axis of said tubular member.

11. A continuous mining operation, comprising:

a continuous miner for excavating and conveying mined materials from within a mine, said miner being movable to a variety of mining locations;

an elongate tubular member having a longitudinal bore formed therein and having a first end and a second end, said tubular member adapted to be mounted with said continuous miner adjacent said second end, said longitudinal bore of said tubular member adapted to be in communication with fluid pressure means adjacent said second end, and said tubular member adapted to be rotated by said continuous miner adjacent said second end;

a scroll having an inner peripheral edge and an outer peripheral edge for use in mining materials from the mine, said scroll radially spiralling along the longitudinal axis of said tubular member from said first end to said second end with said inner peripheral edge being mounted with said tubular member such that rotation of said tubular member results in rotation of said scroll for mining materials from the mine while generating undesired contaminate particulate matter;

spray means terminating adjacent said outer peripheral edge of said scroll and in fluid communication with said fluid pressure means for spraying fluid into the air adjacent said outer peripheral edge of said scroll preventing suspension of mined undesired contaminate particulate matter within the air adjacent to the continuous mining operation; and, anti-clogging means being affixed with said spray means for continuously preventing clogging of said spray means during spraying of the fluid.

12. The continuous mining operation of claim 11, further including:

bit means mounted adjacent said outer peripheral edge of said scroll for mounting appropriate cutting tools for cutting into and loosening the mined materials for removal from the mine.

13. The continuous mining operation of claim 12, wherein:

said spray means terminating adjacent to said bit means on said outer peripheral edge of said scroll to enhance the direction of fluid from said spray means at the undesired contaminate particulate matter generated in proximity to said bit means during mining operations for preventing suspension of undesired contaminate particulate matter within the air.

14. The continuous mining operation of claim 11, wherein said spray means further includes:

at least one body member adapted to be mounted with said scroll, said body member having an orifice formed therein, said body member being in fluid communication with said fluid pressure means.

15. The continuous mining operation of claim 14, wherein said anti-clogging means includes:

insert means movably mounted in said orifice of said body member for agitation by the fluid flowing through said orifice to prevent clogging of said orifice with mined particulate matter during continuous mining operations and to enhance dispersion of the fluid.

16. The continuous mining operation of claim 15, wherein said insert means includes:

a cotter pin disposed within said orifice and adapted to be agitated by the fluid flowing through said orifice preventing clogging of said orifice and enhancing dispersion of the fluid.

* * * * *